US005162603A

United States Patent [19]

Bunker

[11] Patent Number: 5,162,603

[45] Date of Patent: Nov. 10, 1992

[54] MUTING FOR TOUCH GUITAR

[76] Inventor: David D. Bunker, The Chernay Bldg., S. Main St. (PBC), Coopersburg, Pa. 18036

[21] Appl. No.: 641,661

[22] Filed: Jan. 15, 1991

[51] Int. Cl.[5] ..... G10H 1/02; G10H 3/18

[52] U.S. Cl. ..... 84/737; 84/DIG. 30

[58] Field of Search ..... 84/646, 722–724, 84/726–728, 731, 733, 734, DIG. 30, 737, 738, 742

[56] References Cited

U.S. PATENT DOCUMENTS

| | | | |
|---|---|---|---|
| 4,321,852 | 3/1982 | Young, Jr. | 84/DIG. 30 |
| 4,372,187 | 2/1983 | Berg | 84/DIG. 30 |
| 4,760,767 | 8/1988 | Tsurbuchi | 84/DIG. 30 |
| 5,024,134 | 6/1991 | Uchiyama | 84/722 X |

*Primary Examiner*—Stanley J. Witkowski
*Attorney, Agent, or Firm*—Synnestvedt & Lechner

[57] ABSTRACT

Muting of an electric guitar is accomplished by sensing depression of a string by the player during playing, and deactivating an electrical muting circuit in response to said depression. To sense string depression, each electrically-conductive string is supplied with a voltage with respect to the metal frets of the guitar, so that upon depression of any string a current flows through that string to a corresponding transistor which turns off the normal muting of that string; upon release of the string, the current stops and the muting resumes. The muting is preferably accomplished for each string by a corresponding respective FET, normally turned on to short-circuit to ground the audio signal from that string. Resistance-capacitance circuits are provided to control how fast the muting is turned on and off.

11 Claims, 5 Drawing Sheets

MUTING FOR TOUCH GUITAR

FIELD OF THE INVENTION

This invention relates to improvements in electrical stringed-instrument systems, and particularly to improvements in the muting or damping of the sounds produced by the vibrations of the strings therein, when they are no longer intended to be heard.

BACKGROUND OF THE INVENTION

While applicable to other musical instruments, this invention will be described with particular reference to touch-actuated stringed musical instruments, of which the so-called touch guitar is an example, in which the vibration of the string which produces the musical sound is initiated by depressing the string against an underlying substrate, typically the fingerboard or a fret, the resulting vibration of the string being used as a source of the desired musical sounds without requiring any plucking, bowing or strumming of the strings. Aside from the fact that such action makes possible appreciably different musical sounds unique to such touch operation, it also makes possible the use of both hands in fingering the strings, since neither hand is needed for plucking, bowing or strumming, for example. This has made possible a dual-neck guitar, for example, having six strings on one neck for playing with one hand and four other strings, typically the bass strings, mounted on another neck for playing with the other hand. One difficulty with such instruments is that when the string is released at the intended end of a note, it is left free to vibrate at its natural open string frequency, and this not only provides a continuance of sound beyond when it is desired that it terminate, but also produces a frequency or tone which is other than that desired. For this reason, it has been found highly desirable to eliminate sound produced by the vibrating string very shortly after it is released, i.e. to mute the system at such times.

This has been accomplished, at least to some degree, by placing against each string a damping substance such as a body of felt, whereby when the finger is removed from the string the vibrations will be rather rapidly damped out by the felt. This, however, has been found to be somewhat unreliable with respect to the extent of damping provided under different conditions, and of course is also not adjustable; in addition, if applied so as to heavily damp the string after it is released, it will also tend to damp the string during the desired activation intervals.

Another known arrangement for muting or damping the string vibrations utilizes an electrical muting circuit. An electrical pickup senses the vibration of the strings and produces a corresponding electrical signal which is amplified in electronic circuitry to provide the final audible output of musical sound; within this electronic circuitry there is located a mute circuit, which prevents the electrical signals from passing to and through the amplifier until a string produces an audio signal large enough to operate a control circuit for the mute device which renders the mute ineffective, so that the audio tone can then pass to the final amplifying stages; when the string is released, the vibrations of the strings die down to a point where the corresponding electrical signal level falls below a certain threshold, and the muting circuit then mutes the audible effects of any continuing vibration of the string.

This arrangement has also been found to have a number of drawbacks. First, in order for the mute circuit to be deactivated and an output produced, the string vibrations must increase to a certain level, and it is not until this occurs that the output sound occurs; this means that at least a small amount of the initial sound, or attack, may be missed or distorted slightly when the string vibration first occurs. Secondly, the point at which the mute circuit is turned on and off depends upon the strength or loudness of the string vibration; for loud sounds the mute will be turned off faster, but will also remain off longer, than for soft sounds produced by small string vibrations. The latter type of system typically includes a controllable amplifier stage designed so that for very soft playing the gain can be increased to remove the muting more promptly and to reinitiate muting more gradually, thereby to provide a more natural sounding termination. For large vibrations of the strings, this amplifier would normally be turned by the operator to a lower gain setting. However, to adjust the gain for various levels of input is obviously difficult, especially where loud and soft passages follow each other in the same musical piece. In addition, when the gain is turned up to a high level to accommodate small string vibrations, the system tends to become "hot", in that very small vibrations of the instrument itself due to handling, or even feedback from the output amplifiers may induce a string (particularly an open string) to vibrate sufficiently that it can deactuate the mute circuit and produce undesired output sound.

Accordingly, it is an object of the present invention to provide a new and improved system for the muting of stringed instruments.

Another object is to provide such muting system which is affirmative and predictable in operation, and readily controlled and arranged to provide predetermined optimum effects.

SUMMARY OF THE INVENTION

These and other objects of the invention are achieved by the provision of a muting system comprising sensing means for sensing the beginning and end of actuation of a string to produce control signals indicative of the times of occurrence thereof, and a muting circuit responsive to these control signals to initiate enablement of the audible output due to vibration of a string upon the beginning of said actuation, and to initiate muting of the audible output due to that string upon termination of its actuation.

Preferably the sensing means comprises means for sensing contact between each conductive string and a conductive fret, as by applying a voltage between each string and each fret and sensing the current which flows when a string contacts a fret. In a preferred embodiment, the audio signal representing the vibration of each string is shorted to a point at reference potential through an electronic switch, the short-circuit being removed in response to contact between a string and a fret, and resumed in response to termination of said contact. Preferably, in certain embodiments, a predetermined delay is introduced between the time when contact is terminated and the time when muting of the audible output actually resumes; in some embodiments, a predetermined delay is introduced between the time when the contact between string and fret is made and the time when muting is removed.

BRIEF DESCRIPTION OF THE FIGURES

These and other objects and features of the invention will be more readily understood from a consideration of the following detailed description, taken with the accompanying drawings, in which.

DETAILED DESCRIPTION OF SPECIFIC EMBODIMENTS

Figure 1:
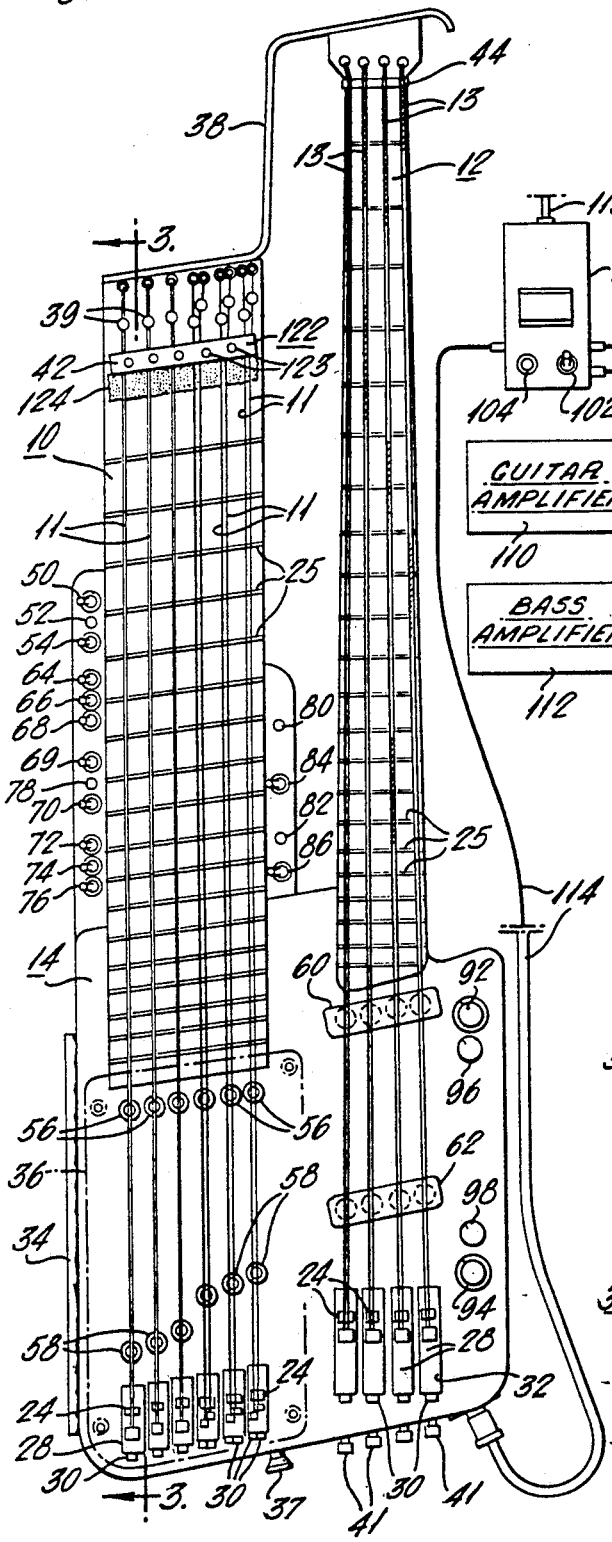
FIG. 1 is a front plan view of a preferred embodiment of a guitar according to the subject invention, with other elements of the system shown generally.
Figure 2:
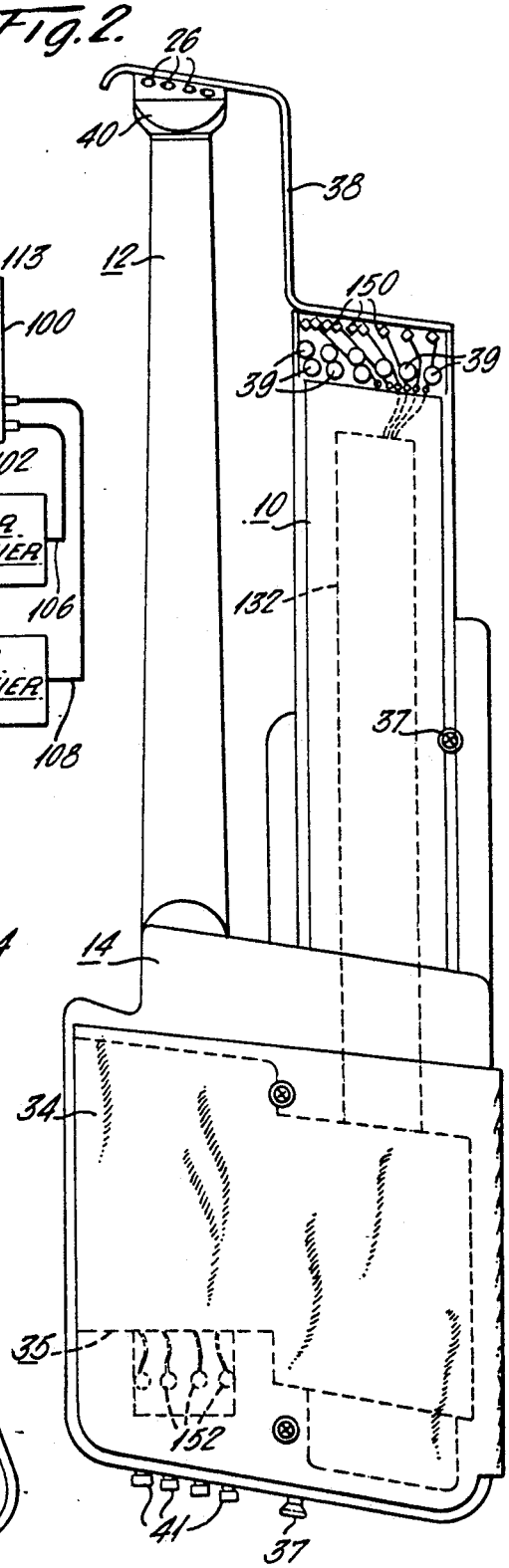
FIG. 2 is a rear plan view of the guitar of FIG. 1.

Referring now to the preferred embodiment of the invention shown in the drawings by way of example only, FIGS. 1 and 2 show a dual-neck guitar having a guitar neck 10 carrying nine electrically-conductive strings such as 11, and a bass neck 12 carrying four electrically-conductive bass strings such as 13 of larger diameter, suitable for playing bass notes lower in frequency of vibration than the guitar strings. In this example, six of the nine guitar strings are grouped into three closely-spaced pairs, so that in effect there are only six strings played and sensed, and herein each such pair will be treated as a single string. The two necks extend from a common supporting body 14, and each string extends over its own separate bridge such as 24. The usual frets, such as 25, are positioned at spaced intervals along each neck, and are of an electrically-conductive material such as steel or a conductive alloy thereof.

Each string of the guitar neck is held at its distal end by a retainer such as 26 and at its opposite, or body, end by a tensioner such as 28 adjustably positionable longitudinally by a rotatable knob such as 30, which moves the tensioner along a track 32.

The body 14 is hollow, and contains beneath its rear cover 34 the body electronics 35 for the system. A front removable arm cover 36 preferably covers the body end of the guitar strings and serves as an armrest in use, the instrument being played by holding it with the guitar neck upward, to be played by fingers of the right hand, while the bass strings are played by the left hand with the left arm extending behind and around the bass guitar neck in the manner usual for an electric guitar. A strap (not shown) is attached to strap fasteners 37 and extends around the neck of the player to support the instrument while it is being played.

In this embodiment, the distal ends of the guitar neck and of the bass neck are preferably joined by a metal strip 38 which provides additional support for the relatively less sturdy bass neck; the bass neck itself preferably utilizes a mechanical construction of the general type in which a metal post extends from a support in the body through the bass neck to butt 40 of the bass neck, with the main section of the bass neck being mounted free of the butt. This permits the tension of the bass strings to be absorbed by the central post, rather than by the relatively long, cantilevered bass neck itself, so as to avoid undue stress on the bass neck due to the bass string tension.

As mentioned above, in the case of the guitar strings, course tuning is provided by course tuning knobs such as 30, with fine tuning being accomplished by the fine tuner posts such as 39; for bass strings, tuning is effected by the knobs such as 41. Suitable transverse supports 42 and 44 are provided for the strings at the distal ends of the necks.

In the preferred embodiment shown, a variety of electronic controls are provided on the guitar itself. Considering first the group of controls positioned along the left edge of the guitar neck, these comprise ten two-way manually operable switches and two pilot lights. Starting from the top, the filter pass switch 50 in one of its positions causes the audio signals from the guitar to bypass the combination of a high-pass filter, a low-pass filter and a mid-band filter located in the guitar electronics, as described more fully hereinafter. This will generally provide a very realistic sound in the final audible output.

Next along the left side of the guitar is a pilot light 52 which indicates whether the neck pickup switch 54 is operated to the position in which the outputs of the guitar neck pickups are turned on, or to the position in which they are turned off. More particularly, across the guitar side of the body there is provided a first set of guitar neck pickup devices 56 positioned under the guitar strings near the guitar neck, and another set of guitar bridge pickups 58 is positioned under the guitar strings nearer to the guitar bridges. The bass section of the instrument is also provided with a set of bass neck pickups such as 60, one under each bass string and positioned near the bass neck, and a second set of bass bridge pickup devices such as 62, one under each bass string and positioned nearer to the bridges.

Each pickup constitutes in essence a wire coil of known form for sensing adjacent vibrations of its corresponding string, to produce electrical currents corresponding thereto and of the same frequencies. The neck pickups have been found to produce a different quality of sound than the bridge pickups, due to their different locations along the strings, and it is for this reason that switches are provided so that the user can select whether the guitar neck pickups or the bridge pickups are being used at any time, according to his preference.

Switch 64 when turned on passes the guitar output through a high pass filter to enhance the high frequencies, switch 66 when turned on passes these signals through a mid-frequency filter to enhance the mid-frequencies, and switch 68 when turned on passes the guitar output through a low-pass filter to enhance low-frequencies. Switches 69, 70, 72, 74 and 76, and pilot light 78 perform directly analogous respective functions for the signals from the bridge pickups for these same guitar strings.

On the side of the guitar neck toward the bass neck there are provided two pilot lights 80 and 82 and two switches 84 and 86 having the following functions in connection with the guitar electronics. Switch 84 is a three-position switch serving as a bass pickup control, such that when in one position the bridge pickups are connected in circuit; when in its other position, only the neck bass pickup devices are effective, and when in a third, center position both sets of pickups are effective for the bass strings. Pilot lights 80 and 82 serve to indicate the three states of the three-position switch 84 by presenting one light on, the other light on, or both lights on.

Switch 86 has two positions, in one of which the damping or muting described hereinafter is electrically removed and rendered ineffective, and in the other position of which the muting system is connected to operate as described hereinafter.

Along the right hand side of the instrument body, as shown in FIG. 1, are four other manual controls for use by the player. More particularly, a guitar volume control 92 is provided which controls the strength of the signals produced by the instrument in response to operation of the guitar strings; bass volume control 94 provides the same function for the signals due to the four bass strings.

Control 96 serves as a guitar pickup pan control, to adjust the relative strength or balance between the signals representing the guitar string vibrations from the guitar neck pickups and from the guitar bridge pickups. In addition, a bass tone control 98 is provided which preferably adjusts the bass tone as discussed hereinafter.

A power supply unit 100 is provided comprising an appropriate power supply switch 102 to turn the power on and off, a power-on indicating light 104, and signal output lines 106 and 108 leading to the guitar amplifier 110 and the bass amplifier 112, which actually provide the final amplified audible signals. A main cable 113 supplies power to the electronics in body 14, and cable 114 delivers the audio signals from the body electronics to the power supply unit.

Adjustments for the heights of the strings are preferably also provided; in the case of the guitar neck, a string bar 122 is preferably used, extending transversely over the guitar strings near the distal end thereof and provided with screw adjustments such as 123 permitting some degree of raising or lowering of the individual strings with respect to the adjacent guitar neck surface. A strip 124 of felt-like damping material may also be used as shown.

Figure 3:
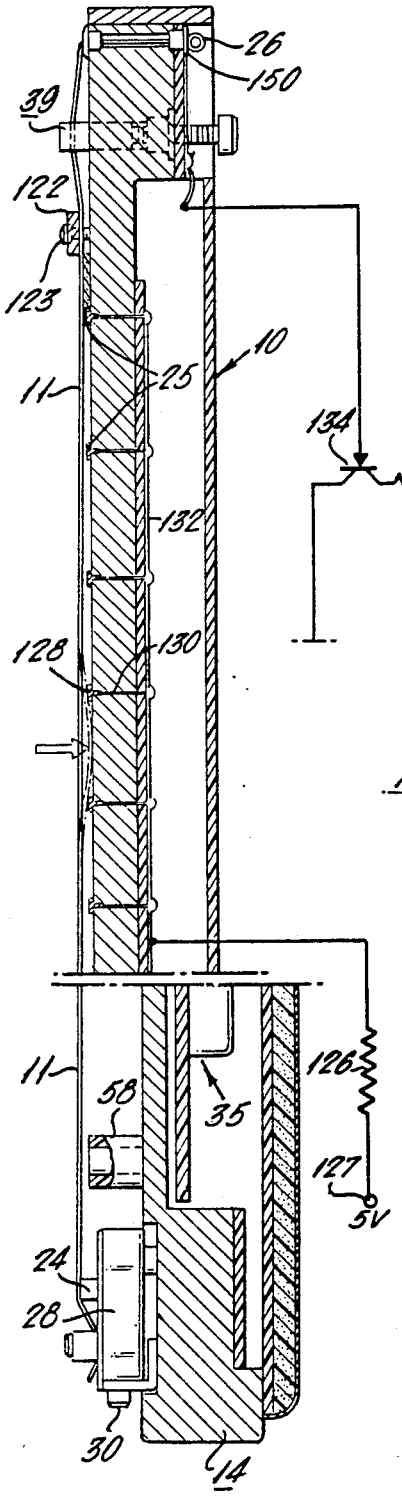
FIG. 3 is a transverse sectional view taken along line 3—3 of FIG. 1.

Turning now to the portion of the system particularly involved with the muting action according to the present invention, the neck portions of both the guitar neck and the bass neck are hollow to provide for the desired electrical connections. As shown in FIG. 3, each string, whether guitar or bass string, is connected through an individual resistor such as 126 to a source of positive supply potential 127, typically 5 volts DC, only when the string is depressed to contact any one of the frets, such as 128 in FIG. 3, each of which frets carries the 5 volt potential. More particularly, each guitar fret has a conductive connection such as 130 extending through the wall of the adjacent neck to a common printed-circuit bus 132; a similar type of construction is preferably used in the bass neck. Each bus is connected at one end, through an appropriate series resistor 126 in the body electronics, to the +5-volt supply 127. Thus all frets are operating at +5 volts when free of string contact. Whenever any string is depressed so as to contact one of the frets, a current flows from the +5-volt source through the series resistor 126 for that string, through the fret, and through the string to a lead connecting that string to the base of a corresponding transistor such as 134, as will be described later herein. In the case of the guitar strings, the connections to the strings are made by connectors such as 150 (FIG. 3) at the distal ends of the strings; for the bass strings, these connections are made to the string bridges, as shown at 152 (FIG. 2).

Having described the general physical arrangement of the two-necked guitar preferably utilized in the preferred embodiment of the invention, the muting system of the invention and its operation will now readily be understood from a consideration of the block diagrams, electrical schematic diagrams and graphical representations described below.

Figure 4:
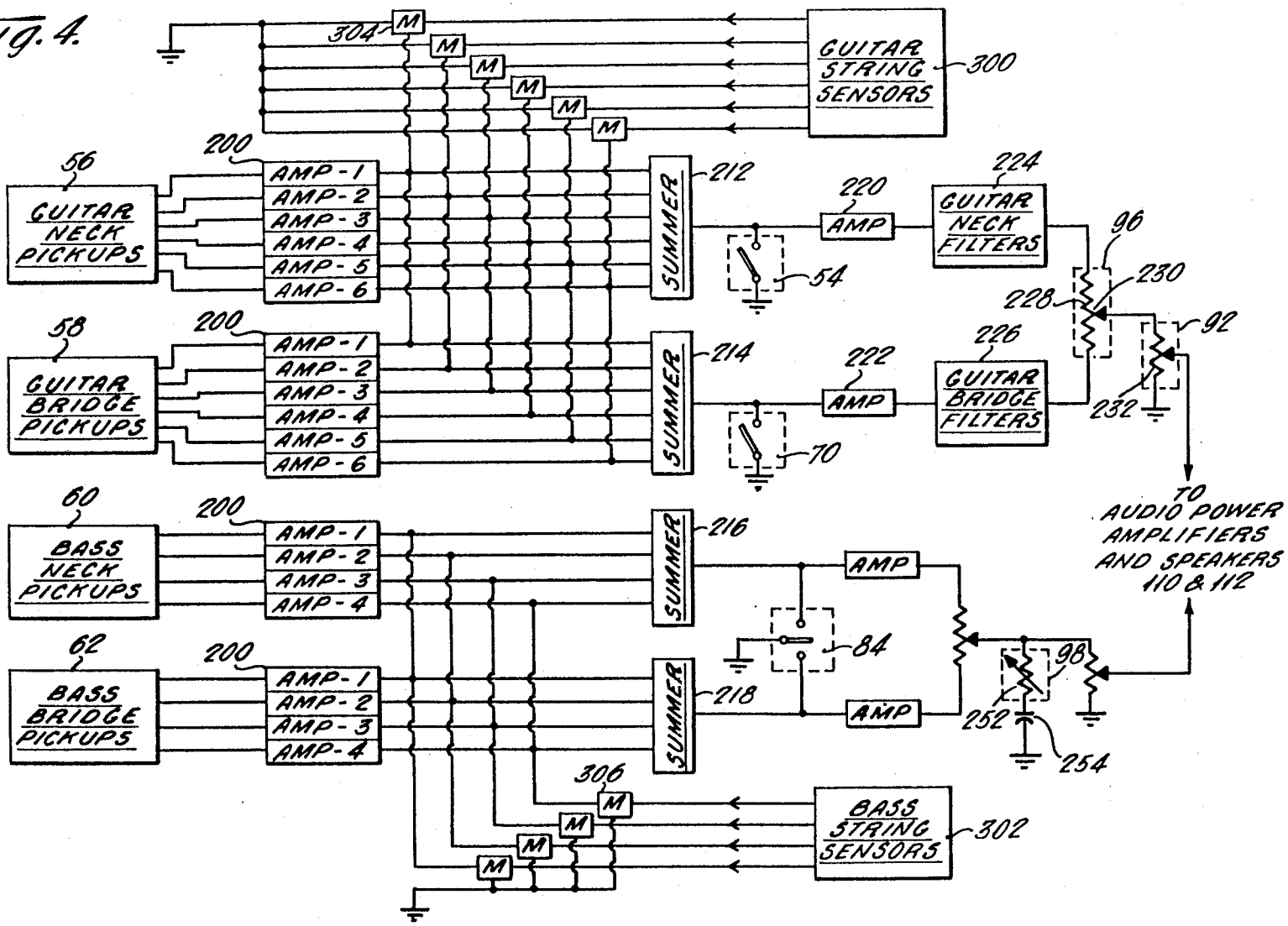
FIG. 4 is a block diagram of a complete preferred system.

The overall system is represented in FIG. 4. Each of the six guitar neck pickups 56, the six guitar bridge pickups 58, the four bass neck pickups 60 and the four bass bridge pickups 62 supply their respective outputs to corresponding respective amplifiers such as 200 in the body electronics 35 (see FIG. 2). The six amplifiers for the guitar neck pickups supply their outputs to the summer 212; the six amplifiers for the guitar bridge pickups supply their outputs to summer 214; the four bass neck amplifiers supply their outputs to summer 216; and the four bass bridge amplifiers supply their outputs to summer 218. The outputs of the summers 212 and 214 are connected through amplifiers 220 and 222 respectively to the guitar neck filters 224 and the guitar bridge filters 226. The switches 54 and 70 referred to previously can be operated as desired to ground the output of either or both of summers 212 and 214, whereby the player can select the output of either the guitar neck pickups or the guitar bridge pickups or both.

The outputs of filters 224 and 226 are supplied to opposite ends of a variably-tapped resistor 228 (pan control 96) to permit selection of the relative quantities of signals from switch bridge and neck pickups. The signal at the variable tap 230 is supplied to another variably-tapped resistor 232, the position of this tap being controlled by guitar volume control 92.

The bass string signals are handled similarly by summers 216, 218, except that a three-position switch 84 is used which has a third position in which it passes the outputs of both of the summers 216 and 218, if desired, and in that there are no filters for the bass signals; instead, a simple tone control circuit comprising variable resistor 252 and capacitor 254 is provided, controlled by bass tone control 98 on the guitar neck. Also, the pan control for the bass is in the body electronics, rather than being externally available.

The muting system includes guitar string sensors 300 and bass string sensors 302, which sense when any string is actuated, and respond to such actuation by operating a corresponding electronic switch such as 304 or 306 to remove the muting of the corresponding string. More particularly, the muting electronic switches (preferably in the form of FET's) normally provide a short to ground for all of the outputs of amplifiers 200, but when the string corresponding to any such amplifier is actuated, as by moving it against a fret, the corresponding FET switch opens and permits the signal due to the actuated string to pass through the system until the string is again released.

Figure 5:
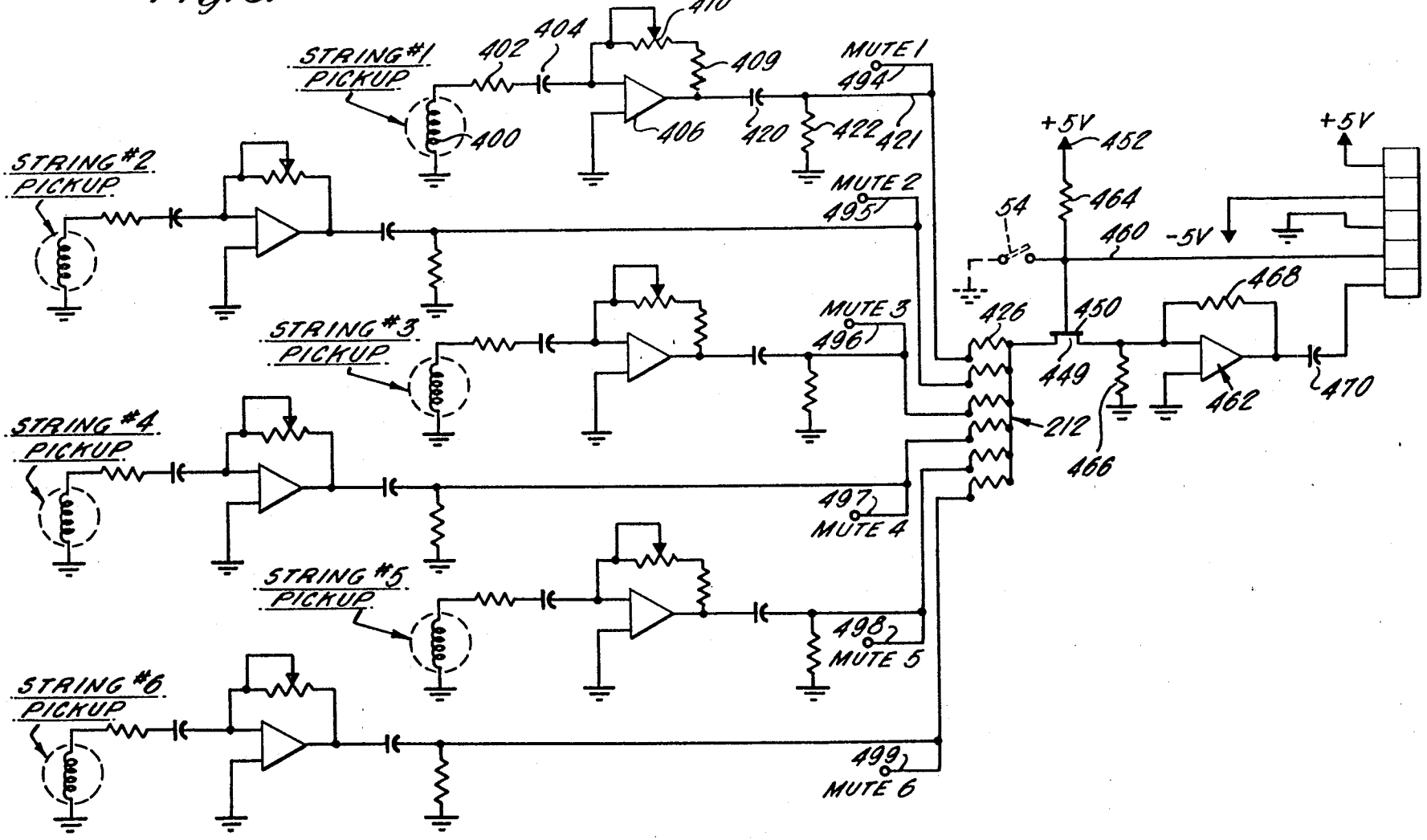
FIG. 5 is a schematic electrical diagram of a preferred circuit for detecting and amplifying signals due to vibration of the strings of the guitar of FIG. 1.

Referring now to FIG. 5 which shows six typical string pickup amplifier channels, one for each guitar string output, only one of these need be described in detail since the others may be substantially identical. String pickup 400 for string #1 of the guitar neck pickups is grounded at one end, and its other end is connected through series resistor 402 and capacitor 404 to the signal input terminal of a transistor operational amplifier 406 of standard configuration, the other input terminal of which is grounded; its output terminal is connected back through fixed resistor 409 and adjustable resistor 410 to its signal input terminal. The adjustable feedback resistor 410 permits adjustment of the relative gains of the amplifiers for the different strings, to achieve equality of output or to produce any predetermined difference in output which may be desired. The output of the operational amplifier in each case passes through a series capacitor 420 to shunt resistor 422, and to a corresponding respective one of the summing resistors, such as 426 in the signal summer 212.

Resistor 402 in the amplifier input circuit may typically have a value of about 1,000 ohms, capacitor 404 a value of about 2.2 microfarads, resistor 409 a value of about 10,000 ohms and resistor 410 a variable value of from 0 to 50,000 ohms. The transistor may be a type LM-324. Series output capacitor 420 may typically have a value of 0.01 microfarad and shunt resistor 422 may typically have a value of about 100,000 ohms. The input and output resistors and capacitors described are to provide DC blocking and filtering against undesired noise. It will be understood that all of the operational amplifiers in the system are provided with appropriate DC operating supply voltages, not shown.

As mentioned above and shown in FIG. 5, each string amplifier output is passed through its own separate individual summing resistor such as 426. A typical value for each summing resistor is 10,000 ohms. The output of the summer is supplied to a field effect transistor (FET) amplifier 449 supplied with operating supply voltage on its control electrode 450 from the +5-volt supply point 452 by way of a suitable dropping resistor 464, which may have a value of about 100 ohms. The output of amplifier 449 may be shut off and prevented from producing audible output by grounding of its control electrode 450 through the switch. This is accomplished in this case by means of line 460 extending to the previously-described manually operable switch 54 on the guitar neck, so that line 460 may be grounded through the latter switch when it is desired to shut off the entire set of guitar neck pickups. This on/off control is suggested by the broken-line switch and ground in FIG. 5. The same type of circuitry is preferably used to turn on and off the bass pickups by means of manual switch 80 on the guitar body.

The output of transistor 449 is supplied to a transistor pre-amplifier 462, which may be a type LM-358 with an associated shunt input resistor 466, a feedback resistor 468 and an output capacitor 470, which may have respective values of 100,000 ohms, 15,000 ohms and 0.01 microfarad. The output passed through the latter capacitor constitutes the total audio signal from all of the guitar neck pickups, when the guitar neck pickup switch is in the on position. Similar amplifying and combining circuits may be used for the guitar bridge pickups, the bass bridge pickups and bass neck pickups.

Importantly, the ends of the summing resistors 426 to which the individual string amplifying channels are connected are each also supplied separately and individually with a mute line, numbered 494 through 499 in FIG. 5. As will be shown in more detail, the subject system normally provides muting of all of the string signals by electronically grounding all of the mute lines (such as 494 to 499) for all of the four sets of pickups. However, when a string is actuated and thereby contacts one of the frets, the corrsponding mute line is effectively open-circuited so that the associated summer receives the audio output signals due to the actuated string, and passes them along to the amplifier 462.

Figure 6:
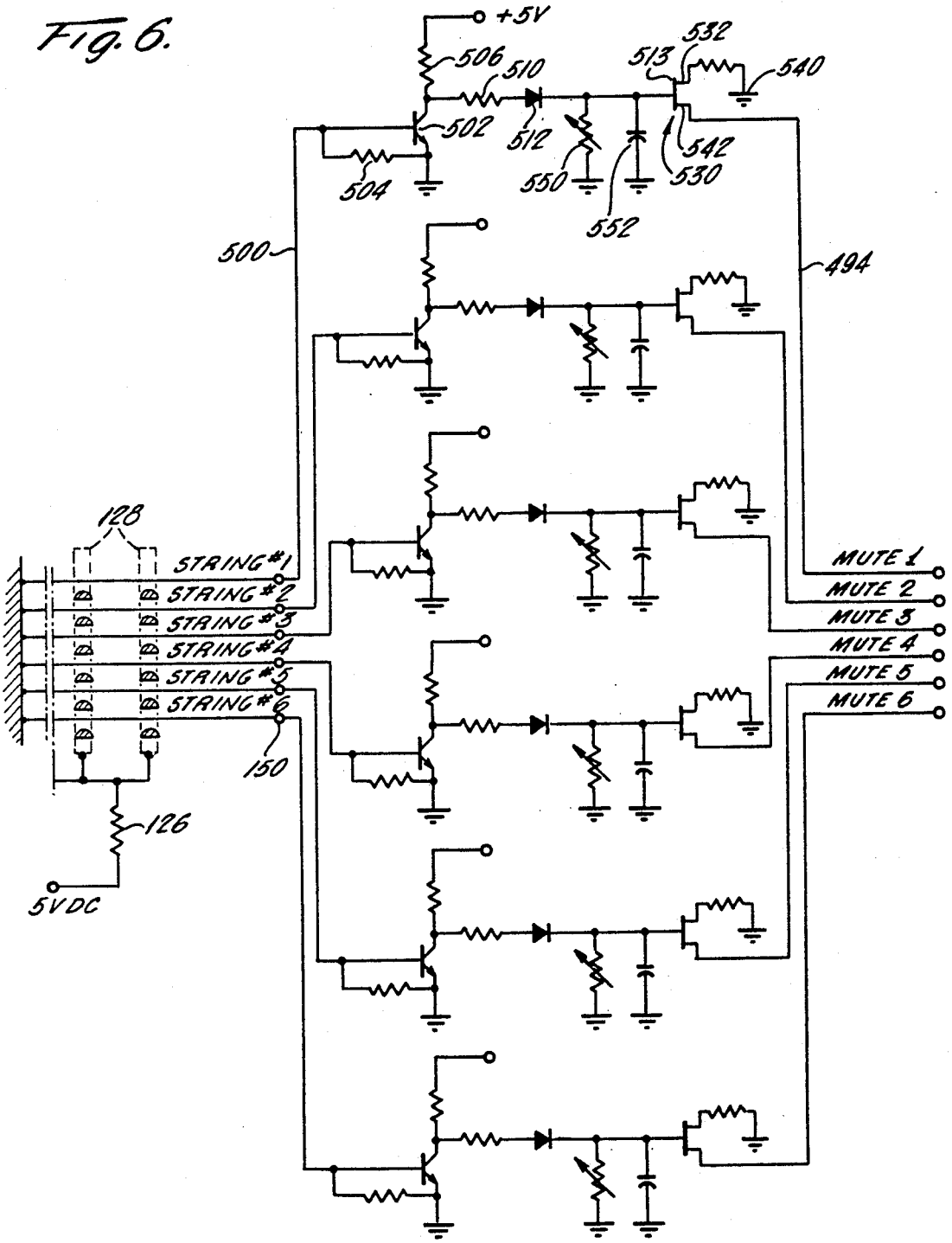
FIG. 6 is a schematic electrical diagram of the preferred muting circuit used in the guitar of FIG. 1.

In FIG. 6, the mute circuits for six sets of strings, for example the guitar neck strings, are shown. All of the mute circuits are substantially the same, hence only one need be described in detail, namely that for string #1.

String #1 is connected over line 500 to the base of transistor 502, which is connected in the grounded-emitter configuration, with a resistor 504 between its base and ground and a collector resistor 506 connected from collector to the +5 supply source. In the case of the bass string muting, the collector supply voltage is connected through the switch 86 on the guitar body (FIG. 1), whereby the collector voltages for muting all input amplifiers can be switched to ground, thereby defeating the bass muting when the player so desires. Resistor 504 may have a value of 680 ohms and resistor 506 a value of 1,000 ohms.

When no string is depressed against a fret, transistor 502 is substantially non-conductive, or at least in a low-conduction state, but when the string is actuated during playing so that it contacts the fret, the voltage supplied through that string to the base of transistor 502 turns that transistor substantially fully on, even for very light and brief contacts of string to fret, thereby dropping its collector voltage abruptly. The voltage at the collector of transistor 502 is applied through resistor 510 and rectifying diode 512 to the control element 513 of field-effect transistor (FET) 530. Electrode 532 of FET 530 is connected to ground through resistor 540, and its other electrode 542 is connected directly to mute line 494. As described previously, mute line 494 is in turn connected directly to the output line of the amplifier 406 for string #1.

Since transistor 502 is normally in a low-conduction state, its collector voltage is normally at a relatively high positive value, sufficient to pass through diode 512 and maintain FET 530 in a highly-conductive state to hold muting output line 494 at substantially ground potential; as described previously with respect to FIG. 4, holding this line at ground potential wipes out or mutes the audio signal otherwise produced on amplifier output line 421 by string number one.

This normally muted condition is true with respect to all of the strings, and accordingly the instrument normally is not "hot", and is not responsive to chance mechanical or electrical disturbances which might otherwise manifest themselves in the final audio output of the system.

As pointed out above, when any string is depressed against a fret, the resultant voltage on the string causes the transistor 502 to conduct and its collector to go sharply negative, so that conduction through diode 512 no longer occurs and FET 530 is cut off, thus permitting the corresponding string #1 amplifier output to pass on to the final amplifier for audible rendition thereof. That is, the muting is removed by such actuation of the string, and the string then produces its audio output. How long it takes for FET 530 to be cut off depends on the RC time constant of resistor 550 and capacitor 552, the larger RC the greater the delay; normally RC is made small. In the present preferred embodiment, resistor 510 may have a value of 1,000 ohms, resistor 550 a value of 100,000 ohms and capacitor 552 a value of 0.047 microfarad. FET 530 is preferably a type 5505.

When the string is released so that it no longer contacts any fret, transistor 502 again becomes substantially cut off, and the muting circuit returns to its normal condition in which the mute line 494 is grounded and the output from string one is muted, i.e. eliminated.

How fast this occurs depends upon the circuit time constants.

More particularly, when the string is released so that contact with a fret terminates, capacitor 552 begins to charge up positively from transistor 502, through series resistor 510. The RC product of resistor 510 and capacitor 552 primarily determines the rate of such charging and hence the time delay before FET 530 becomes fully conductive. Accordingly, by selection of the values of resistor 510 and capacitor 552, the delay for turning on the muting action can be controlled. Different values of resistance and capacitance can be provided by switching different resistors or capacitors selectively in and out of circuit, or by utilizing a variable value of resistor, for example.

It has been found that the above-described arrangement in which the muting is accomplished by, in effect, connecting the string audio output to ground through FET 530, rather than by using the muting signal to open and close a gate through which the audio signal passes in series, is highly advantageous with respect to the substantial absence of extraneous noises such as clicks or pops, which tend to occur in the final audible output signal when a pass-through type of gate circuit is utilized instead.

Figure 7:
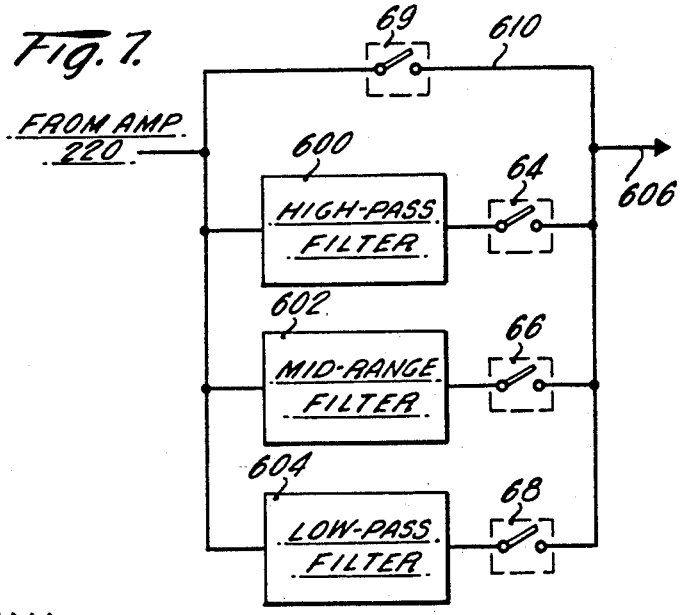
FIG. 7 is a block diagram illustrating a suitable arrangement of filters for use in the system.

FIG. 7 shows schematically a functional arrangement of the filters 224 and 226 of FIG. 4 which may be used, this circuitry being contained within the body of the guitar. The filters 224 and 226 are the same, and only one set of switch filters is shown. As shown, signals from the amplifier 220 in FIG. 4 are supplied to a high-pass filter 600, a mid-range filter 602 and a low-pass filter 604, the outputs of which are combined on line 606. A bypass line 610 is also provided, bypassing all of the filters. Switches 64, 66, 68 and 69, respectively, are connected in series with filters 600, 602 and 604 and in bypass line 610, so that the audio signal output at line 606 can be made to comprise any desired combination of signals passed by any of the switches, and to provide any desired effect in the output signal. Thus if switch 69 is closed, the entire filter is bypassed and the natural audio tone results. By closing any combination of the switches 64, 66 and/or 68, audio signal from the high-pass filter, the mid-pass filter and/or the low-pass filter can be selected or combined for final presentation at summing point 606.

Figure 8:
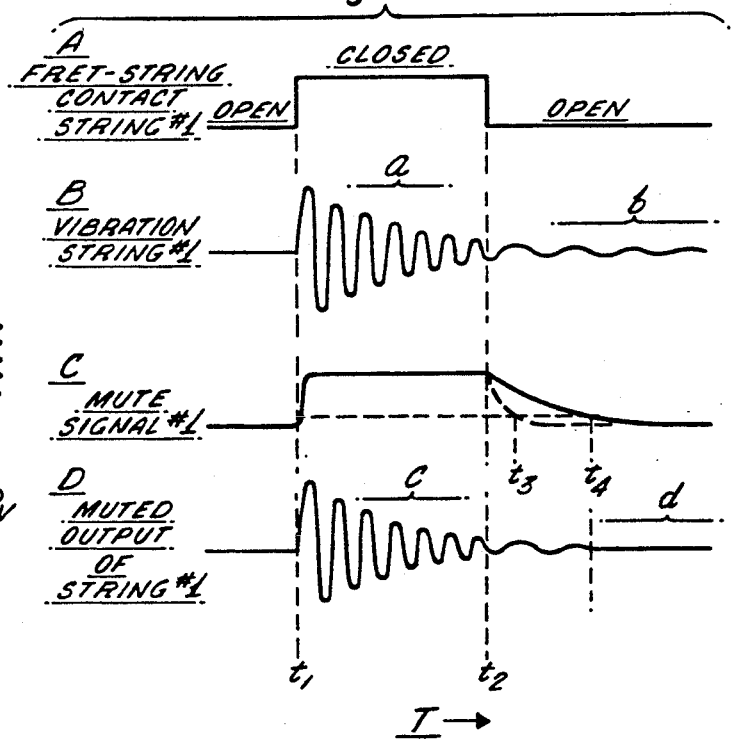
FIGS. 8A–D are a series of graphical representations to which reference will be made in explaining the operation of the invention in a preferred form.

The graphical representations of FIG. 8 illustrate in idealized form the general principle of operation of the muting system. In each graph, abscisae represent time to the same scale. FIG. 8A shows the actuated and deactuated conditions of a typical string such as string #1, which is initially open (free of contact with a fret or fingerboard surface), which is then actuated (closed) by holding it against a fret from time $t_1$ to $t_2$ and then allowed to reopen.

FIG. 8B represents the amplitude of the string vibrations under such circumstance in the absence of the present invention. The impacting of the string against the fret induces vibrations at the frequency of the string, for a string length determined by the fret position, to produce the relatively large initial amplitude of vibration as shown; when the actuation terminates at $t_2$, that is when the string is released, the string will tend to continue to vibrate at a relatively smaller amplitude, and typically at a lower frequency since a longer length of string is operative in the open-string condition. It is this latter continuing oscillation shown at b of FIG. 8B which continues long after the string is released and interferes with proper final audio output.

FIG. 8C illustrates the mute signal. Initially, and prior to actuation of the string at $t_1$, the mute signal is low; on the order of zero or ground potential, causing muting of the output. However, when the string is closed to a fret at time $t_1$, the FET mute signal rises as shown in FIG. 8C, permitting the audio signal output to pass and produce the final audible output of the system, as desired. However at $t_2$, when the string is released, the mute signal falls and causes the audio signal to be shorted to ground again, thus preventing any substantial output to occur after the string is released for a short time, as represented at d of FIG. 8D.

It is because of the substantial values of the RC constant in the circuit for the FET mute switch 530 that the FET switch may be caused not to close instantaneously, but only after the capacitor in the RC circuit has discharged for awhile. For example, with an appreciable RC constant the mute switch may not close fully to accomplish muting until the time $t_3$, and with larger values it may in fact not close fully until time $t_4$. Assuming that an RC circuit is used which causes the mute switch to completely short the audio signal to ground only after time $t_4$, there will be no substantial signal variation in the audio signal after the time $t_4$. That is, the undesired long-continuing variations shown at b in FIG. 8B will be eliminated because of the muting of the circuit beginning at time $t_4$. The time constant, hence delay, employed is a matter of individual choice for the particular aesthetic result desired, and as pointed out above can be provided by individual selection of values in building the circuitry, or by provision of a plurality of values of resistance or capacitance between which the resistors and capacitors can be switched, or by making the resistances and/or capacitances manually variable to accomplish the desired effect.

Accordingly, there has been provided a stringed electrical musical instrument having at least one vibratory string which is actuated by a player of the instrument to produce predetermined vibrations thereof; electrical apparatus is employed which is responsive to these vibrations to produce corresponding electrical signals and to produce an audible output in response to the electrical signals when the electrical apparatus is not muted. In addition, the instrument comprises a new muting system for normally muting the audible output when the string is not being actuated. The improved muting system according to the invention comprises sensing means for sensing the beginning and the termination of the string actuation to produce control signals indicative of the times of occurrence of the beginnings and terminations of the string actuations, and a muting circuit responsive to these control signals to initiate the enablement of an audible output upon the beginning of the string actuation and to initiate muting of the audible output upon termination of the string actuation. In this way, the audio output only responds to string vibrations produced during its intended actuation interval. Preferably the sensing is accomplished by using a plurality of conductive frets which are electrically interconnected and provided with a common supply voltage, each string being conductive and connected to a separate respective muting circuit such that when the fret and string are in contact during their actuation, the resultant currents in the string will actuate the electronic circuitry to initiate disablement of the muting action and permit audio output as desired. In this way, undesired post-actuation sound is eliminated, while maintaining the instrument inert rather than "hot" during intervals between actuation, so that it will not be subject to actuation by chance physical or electrical shocks or vibrations inadvertently occurring, such as might produce large audible output or even regenerative feedback causing a whistle or other continuing sound in the audible output.

While the invention has been described with particular reference to specific embodiments in the interest of complete definiteness, it will be understood that it may be embodied in a variety of forms diverse from those specifically shown and described, without departing from the spirit and scope of the invention as defined by the appended claims.

I claim:

1. In a stringed electrical musical instrument comprising: at least one vibratory string which in playing of said instrument is depressed by a player thereof; electrical pick-up means on said instrument and responsive to vibrations of said string to produce corresponding electrical signals; and electrical circuit means supplied with said electrical signals from said pick-up means for producing a corresponding output signal;

the improvement which comprises:

electrical muting means for normally preventing signals from passing through said electrical circuit means;

sensing means on said instrument for sensing each depression and each release of said string by a player of said instrument and for producing mute-control signals representative of the times of occurrence of said each depression and release; and means for deactivating and reactivating said muting means in response to said mute-control signals;

2. An instrument according to claim 1, wherein said instrument comprises a plurality of frets and said string depression comprises holding said at least one string against one of said frets, and said sensing means comprises means for sensing when said at least one string is being held against any of said frets.

3. An instrument according to claim 2, wherein said at least one string and said frets are electrically conductive, and said sensing means comprises sensing the current flow between said at least one string and any of said frets.

4. An instrument according to claim 1, wherein said at least one string comprises a plurality of strings, said sensing means comprise means for separately sensing when each of said strings is depressed and released, and said electrical muting means comprises means for separately enabling and muting said output signal due to the vibrations of the corresponding string.

5. An instrument according to claim 1, wherein said electrical muting means comprises a transistor switch operable in response to signals from said sensing means to short-circuit to a reference potential said output signal produced by said at least one string when muting is desired, and to provide substantially an open circuit at other times.

6. The method of controlling the muting of an electrical stringed instrument having at least one vibrating string, a substrate against which said at least one string is pressed during playing of the instrument, pickup means for converting vibrations of said at least one string into corresponding electrical audio signals, and a muting system for accomplishing muting of said audio signals, said method comprising:

sensing the position of said at least one string with respect to said substrate to produce muting-control signals indicative of when said at least one string is pressed and when it is released by the player;

initiating muting of said audio signals upon said release of said at least one string, and intiating termination of said muting when said at least one string is pressed.

7. The method of claim 6, comprising delaying said termination of muting by a predetermined amount with respect to the time of said release.

8. The method of claim 6 wherein said substrate comprises a plurality of electrically-conductive frets and said at least one string is electrically conductive, and said sensing comprises passing an electrical current through said at least one string only when it is pressed against a portion of said substrate.

9. The method of claim 8, wherein said portion of said substrate is an electrically-conductive fret, said at least one string is electrically conductive, and said passing of said electrical current comprises applying a voltage between said at least one string and said fret only when said at least one string is passed against said fret.

10. An electrical guitar, comprising:

(a) a guitar body and a guitar neck connected thereto;

(b) a plurality of electrically-conductive guitar strings stretched along said neck;

(c) a plurality of electrically-conductive frets spaced along said neck beneath said strings;

(d) means for applying a voltage to said frets, thereby to apply a voltage to each string when it is pressed against one of said frets;

(e) a plurality of pick-up means on said guitar each responsive to vibrations of one of said strings to produce corresponding respective electrical audio signals;

(f) a plurality of muting devices each for controlling the muting of a different one of said respective audio signals;

(g) a plurality of mute-control circuits each responsive to said voltage on a different corresponding one of said strings for controlling the corresponding one of said muting devices to initiate muting of each audio signal when its corresponding string is released and to initiate removal of said muting when its corresponding string is pressed against one of said frets.

11. The systems of claims 10, wherein said mute-control circuits each comprise an electronic switch for shorting the corresponding audio signal to a reference potential when said audio signal is to be muted.

* * * * *